US005140219A

United States Patent [19]

Kane

[11] Patent Number: 5,140,219

[45] Date of Patent: Aug. 18, 1992

[54] FIELD EMISSION DISPLAY DEVICE EMPLOYING AN INTEGRAL PLANAR FIELD EMISSION CONTROL DEVICE

[75] Inventor: Robert C. Kane, Woodstock, Ill.

[73] Assignee: Motorola, Inc., Schaumburg, Ill.

[21] Appl. No.: 662,590

[22] Filed: Feb. 28, 1991

[51] Int. Cl.[5] ..... H01J 1/30; H01J 19/24

[52] U.S. Cl. ..... 313/495; 313/308; 313/309; 313/351

[58] Field of Search ..... 313/309, 308, 495, 336, 313/351, 355

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 4,721,885 | 1/1988 | Brodie | 313/576 |
| 4,728,851 | 3/1988 | Lambe | 313/309 |
| 4,827,177 | 5/1989 | Lee et al. | 313/306 |
| 4,874,981 | 10/1989 | Spindt | 313/309 |
| 4,904,895 | 2/1990 | Tsukamoto et al. | 313/351 X |

FOREIGN PATENT DOCUMENTS

| | | |
|---|---|---|
| 0172089 | 7/1985 | European Pat. Off. . |
| 2604823 | 10/1986 | France . |
| 855782 | 6/1977 | U.S.S.R. . |
| 2204991A | 11/1988 | United Kingdom . |

OTHER PUBLICATIONS

A Vacuum Field Effect Transistor Using Silicon Field Emitter Arrays, by Gray, 1986 IEDM.

Advanced Technology: Flat Cold-Cathode CRTs, by Ivor Brodie, Information Display, Jan. 1989.

Field-Emitter Arrays Applied to Vacuum Fluorescent Display, by Spindt et al. Jan. 1989 issue of IEEE Transactions on Electronic Devices.

Field Emission Cathode Array Development For High--Current Density Applications by Spindt et al., dated Aug. 1982, vol. 16 of Applications of Surface Science.

*Primary Examiner*—Palmer C. DeMeo

*Attorney, Agent, or Firm*—Eugene A. Parsons

[57] ABSTRACT

An integrally controlled field emission device display employing planar field emission devices as controlling elements for non-planar field emission devices utilized for excitation of a cathodoluminescent layer is provided.

6 Claims, 3 Drawing Sheets

FIG.1A
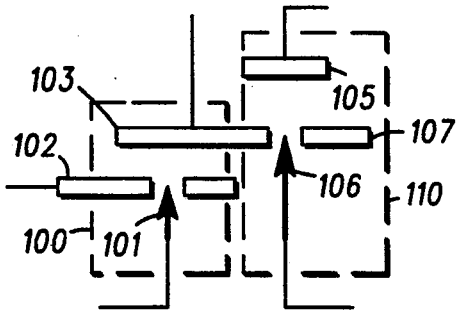
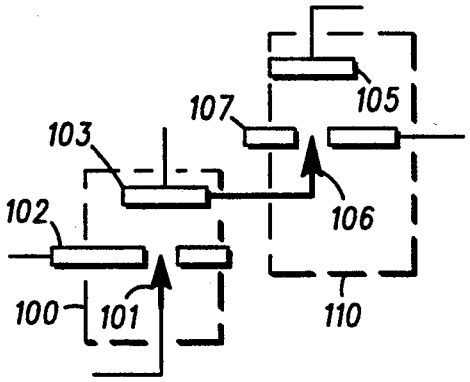
FIG.1B
FIG.2A
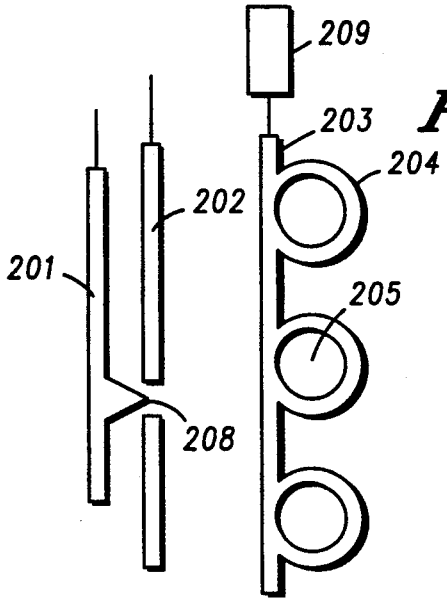
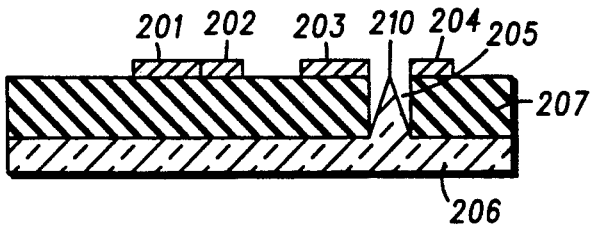
FIG.2B
FIG.3A
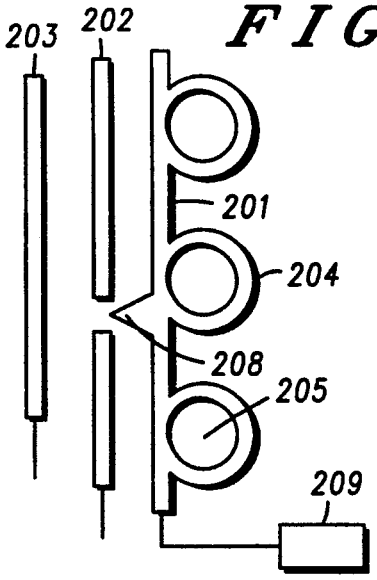
FIG.3B
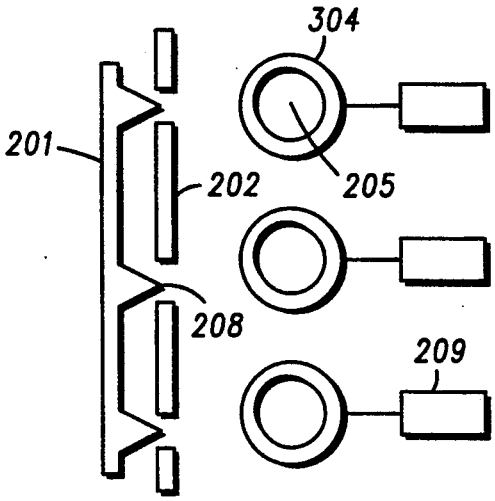

FIG. 3C
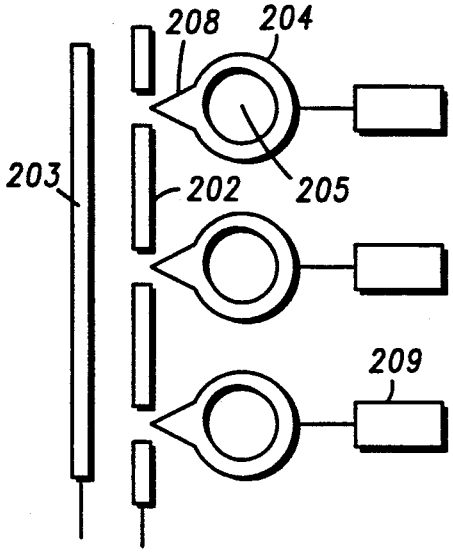
FIG. 3D
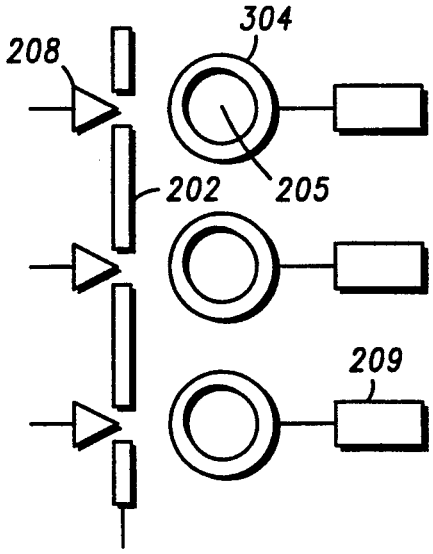
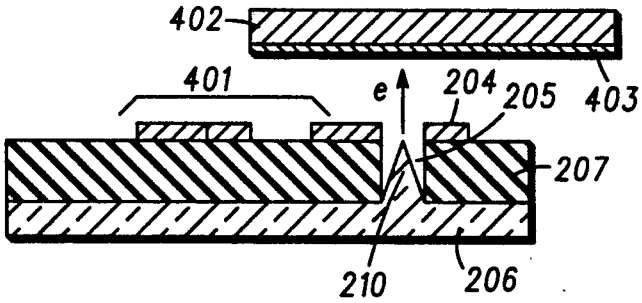
FIG. 4A
FIG. 4B
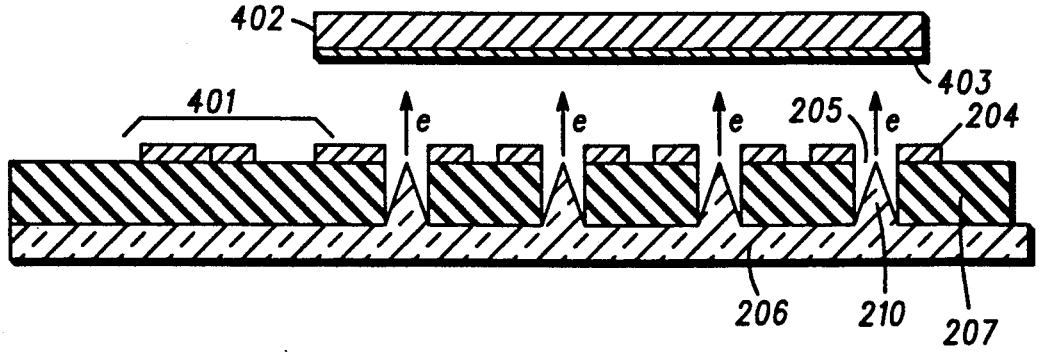

FIELD EMISSION DISPLAY DEVICE EMPLOYING AN INTEGRAL PLANAR FIELD EMISSION CONTROL DEVICE

This application is related to the co-pending application: *Field Emission Device With Vertically Integrated Active Control*; Robert C. Kane, Inventor; Motorola, Inc., Assignee; Ser. No. 07/645,523, Filed Jan. 24, 1991, now U.S. Pat. No. 5,075,595.

TECHNICAL FIELD

This invention relates generally to field emission device displays and more particularly to integrally controlled field emission device displays employing planar field emission devices as controlling elements.

BACKGROUND OF THE INVENTION

Field emission devices (FEDs) are well known in the art and commonly employed in applications requiring an available source of electrons for operation. One such application is an FED display which utilizes pluralities of FEDs, in groups or individually, which emit electrons to energize a cathodoluminescent material that has been deposited onto a surface of a viewing screen or display faceplate. The emitted electrons originate form an FED emitter electrode at a region of geometric discontinuity of small radius of curvature such as a sharp edge or tip. Electron emission is induced by application of potentials of appropriate polarization and magnitude to the various electrodes of the FED display.

FED displays are generally flat displays and differ from cathode ray tube displays in that information is not impressed onto the viewing screen by means of a scanned electron beam, but rather by selectively controlling the rate of electron emission from individual FEDs or select groups of FEDs that form an array comprising the FED display. This method of imparting information to the viewing screen of a display device is termed "pixel addressing" since individual FEDs or select groups of FEDs can be associated with distinct picture elements (pixels) of the viewing screen.

In some instances it is desirable to provide active addressing of the various pixel drivers by employing active switching devices. Commonly used display addressing methods of the prior art utilize discrete active switching devices that reside beyond the extent of the display, and active semiconductor switching devices deposited directly within the display. In the former instance, discrete switching devices add to the complexity of system manufacture, size, and cost while reducing operating efficiency and reliability. In the latter instance, deposited semiconductor switches suffer from poor performance such as slow switching speed, low carrier mobility, high leakage current, and fabrication complexity. Incorporating semiconductor switches onto a substrate which contains the FED pixel drivers would necessarily require an increase in fabrication complexity.

Accordingly, there exists a need for an improved active switching technique for FED display devices that provides relief from at least some of the shortcomings of the prior art.

SUMMARY OF THE INVENTION

This need and others are substantially met through provision of an integrally controlled FED display employing at least a first integrated field emission device as a controlling element substantially for an array of FEDs.

The integrated field emission control device display unit substantially comprises at least: a substrate having at least a primary surface; a first insulator layer substantially disposed on at least a part of the at least primary surface of the substrate and having at least a first aperture; at least a first electron emitter, for emitting electrons, substantially disposed in the at least first aperture of the at least first insulator layer, and further, substantially disposed on at least a part of the primary surface of the substrate; a first non-insulator layer substantially disposed on at least a part of the at least first insulator layer, and substantially formed to comprise at least:

a first integrated field emission control device anode electrode;

a first integrated field emission control device gate electrode; and a first integrated field emission control device emitter electrode, for emitting electrons, wherein at least a part of the at least first integrated electron control device emitter electrode is disposed substantially symmetrically peripherally about at least a part of at least a first aperture; a first display faceplate having at least a first layer of cathodoluminescent material disposed thereon, and being distally disposed with respect to the at least first electron emitter; such that the at least first integrated electron control device substantially controls impingement of the emitted electrons on the at least first layer of cathodoluminescent material.

BRIEF DESCRIPTION OF THE DRAWINGS

FIG. 1A is a first schematic representation of an integrated electron control device, substantially an integrally controlled field emission device, that is utilized to control at least a first FED in a display in accordance with the present invention.

FIG. 1B is a second schematic representation of an integrated electron control device, substantially an integrally controlled field emission device utilized to control at least a first FED in a display in accordance with the present invention.

FIG. 2A is a partial top plan view of a first embodiment of an integrally controlled field emission device display in accordance with the present invention.

FIG. 2B is a partial side-elevational cross-sectional view of the first embodiment of an integrally controlled field emission device display in accordance with the present invention.

FIG. 3A is a partial top plan view of a second embodiment of an integrally controlled field emission device display in accordance with the present invention.

FIG. 3B is a partial top plan view of a third embodiment of an integrally controlled field emission device display in accordance with the present invention.

FIG. 3C is a partial top plan view of a fourth embodiment of an integrally controlled field emission device display in accordance with the present invention.

FIG. 3D is a partial top plan view of a fifth embodiment of an integrally controlled field emission device display in accordance with the present invention.

FIG. 4A is a side-elevational cross-sectional view of the first embodiment of an integrally controlled field emission device display in accordance with the present invention.

FIG. 4B is a side-elevational cross-sectional view of a sixth embodiment of an integrally controlled field emission device display in accordance with the present invention.

DETAILED DESCRIPTION OF A PREFERRED EMBODIMENT

Figure 5A:
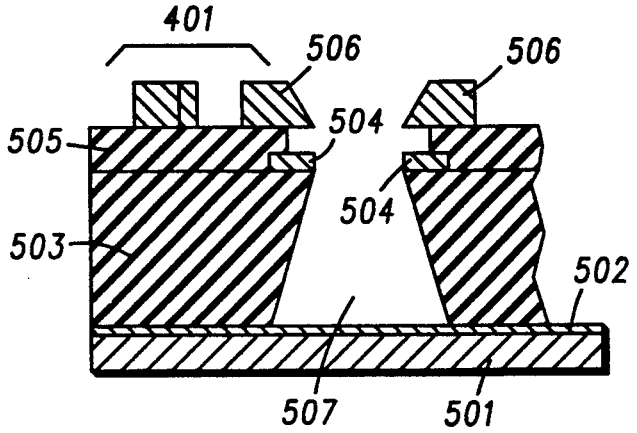
FIG. 5A is a partial side-elevational cross-sectional view of a seventh embodiment of an integrally controlled field emission device display in accordance with the present invention.

FIG. 1A sets forth a first schematic representation of an integrated electron control device, typically an integrally controlled field emission device (FED), that is utilized to control at least a first FED of a display unit in accordance with the present invention. A first FED (100) (delineated schematically within the confines of a first dashed line boundary in FIG. 1) is comprised of at least a first device electron emitter (101), a first device gate extraction electrode (102), and a first device anode electrode (103). A second FED (110) (delineated schematically within the confines of a second dashed line boundary in FIG. 1) is comprised of at least a second device electron emitter (106), a second device gate extraction electrode (107) and a second device anode electrode (105). The first device anode electrode (103) is operably coupled to the second device gate extraction electrode (107). For display applications the second device anode electrode (105) may be comprised of a display faceplate and typically has at least a first layer of cathodoluminescent material disposed thereon, and is distally disposed with respect to the second device electron emitter such that the at least first integrated electron control device substantially controls impingement of the emitted electrons on the at least first layer of cathodoluminescent material.

FIG. 1B sets forth a second schematic representation of an integrated electron control device, typically an integrally controlled field emission device, that is utilized to control at least a first FED of a display unit in accordance with the present invention. A first FED (100) (delineated schematically within the confines of a first dashed line boundary in FIG. 1) is comprised of at least a first device electron emitter (101), a first device gate extraction electrode (102), and a first device anode electrode (103). A second FED (110) (delineated schematically within the confines of a second dashed line boundary in FIG. 1) is comprised of at least a second device electron emitter (106), a second device gate extraction electrode (107) and a second device anode electrode (105). The first device anode electrode (103) is operably coupled to the second device electron emitter (106). A field emission device so constructed provides for first FED (100) control of the second FED (110) by switching/modulating the applied potential to the second device electron emitter (106). The second device anode electrode (105) may be comprised of a display faceplate as described previously with reference to FIG. 1A.

FIG. 2A illustrates a partial top plan view of a first embodiment of an integral field emission control device that is utilized to control at least a first FED of a display unit in accordance with the present invention. At least a first substantially planar FED functions as an integrated controlling FED, and is comprised of at least a first electron emitter electrode (201), for emitting electrons, having at least a first geometric discontinuity of small radius of curvature (emitter tip) (208), at least a first gate extraction electrode (202), and at least a first anode electrode (203), for collecting at least some emitted electrons. For the purposes of practical FEDs, a geometric discontinuity of small radius of curvature is generally considered to mean a discontinuous physical feature exhibiting a radius of curvature of less than 1000 angstroms. The at least first anode electrode (203) is operably coupled to at least a plurality of second device gate extraction electrodes (204) that are each substantially peripherally, symmetrically disposed about one of a plurality of apertures (205). Application of an appropriate potential to the at least first anode electrode (203) of the substantially planar FED also substantially provides application of that potential to the plurality of second device gate extraction electrodes (204). A substantially planar FED emitted electron current collected at the at least first anode electrode (203) influences a potential that exists at the plurality of second device gate extraction electrodes (204) due to an associated potential drop at an at least first impedance element (209) that is operably coupled to the at least first anode electrode (203). In this manner, the at least first integrated substantially planar FED effectively switches/modulates the potential that is applied to the plurality of second device gate extraction electrodes (204). A display faceplate described previously with reference to FIG. 1A may be employed with at least a first second FED, of which only a plurality of gate extraction electrodes (204) are depicted in FIG. 2A, to realize integral FED control of an FED display.

FIG. 2B is a side-elevational cross-sectional depiction of an integral FED control device that is utilized to control at least a first FED of a display unit in accordance with the present invention, partially described earlier with reference to FIG. 2A, and further illustrating a substrate (206), having at least a primary surface, substantially supporting at least some FED elements described above. A first insulator layer (207), having at least a first aperture (205) disposed substantially transversely through the at least first insulator layer (207), is substantially disposed on at least a part of the at least primary surface of the substrate (206). An at least first second device electron emitter electrode (210) is substantially symmetrically disposed within the at least first aperture (205), and further is substantially disposed on the at least primary surface of the supporting substrate (206). An at least first non-insulator layer is disposed on at least a part of the at least first insulator layer (207) such that at least a plurality of electrically isolated regions of the at least first non-insulator layer comprise at least a first substantially planar FED electron emitter electrode (201), at least a first substantially planar FED gate extraction electrode (202), at least a first substantially planar FED anode electrode (203), and at least a first second device gate extraction electrode (204). Application of suitable external potentials (not depicted) to the various electrodes of the substantially planar FED (201, 202, 203) result in FED operation, typically being electron emission from the substantially planar FED electron emitter electrode (201).

A functional integrally FED controlled display is realized by employing a display faceplate (not shown), as described previously with reference to FIG. 1A, as a second device anode electrode of an at least first second FED, of which only a plurality of gate extraction electrodes (204) are depicted in FIG. 2B.

FIG. 3A is a partial top plan view of a second embodiment of an integral field emission control device that is utilized to control at least a first FED of a display unit in accordance with the present invention. At least a first substantially planar FED functions as an integral controlling FED of a display unit, and is comprised of at least a first electron emitter electrode (201), for emitting electrons, that has at least a first geometric discontinuity of small radius of curvature (emitter tip) (208), at least a first gate extraction electrode (202), and at least a first anode electrode (203), for collecting at least some emitted electrons. The at least first electron emitter electrode (201) is operably coupled to at least a plurality of second device gate extraction electrodes (204) that are each substantially peripherally, symmetrically disposed about one of a plurality of apertures (205). Application of an appropriate potential to the at least first electron emitter electrode (201) of the substantially planar FED is operably applied also to at least the plurality of second device gate extraction electrodes (204). Substantially planar FED emitted electron current influences the potential at the plurality of second device gate extraction electrodes (204) due to the associated potential drop at an at least first impedance element (209) that is operably coupled to the at least first electron emitter electrode (201). In this manner, the at least first integrated substantially planar FED effectively switches/modulates the potential that is applied to the plurality of second device gate extraction electrodes (204).

FIG. 3B illustrates a partial top plan view of a third embodiment of an integral field emission control device that is utilized to control at least a plurality of FEDs of a display unit in accordance with the present invention. At least a first substantially planar FED functions to integrally control an FED display unit, the integral FED control being comprised of at least a first electron emitter electrode (201), for emitting electrons, that has at least a plurality of geometric discontinuities of small radius of curvature (emitter tips) (208), at least a first gate extraction electrode (202), and at least a plurality of anode electrodes/second device gate extraction electrodes (304), for collecting at least some emitted electrons, which at least plurality of substantially planar FED anode electrodes/second device gate extraction electrodes (304) are each substantially peripherally, symmetrically disposed about one of a plurality of apertures (205). Substantially planar FED emitted electron current obtained at any of the plurality of substantially planar FED anode electrodes/second device gate extraction electrodes (304) influences the potential at at least a selected one of the plurality of substantially planar FED anode electrodes/second device gate extraction electrodes (304) due to the associated potential drop at the at least first impedance element (209) that is operably coupled to at least a first anode electrode/second device gate extraction electrode (304) of the plurality of substantially planar FED anode electrodes/second device gate extraction electrodes (304). In this manner, the at least first integrated substantially planar FED effectively switches/modulates the potential that is applied to the plurality of second device gate extraction electrodes (304).

FIG. 3C is a partial top plan view of a fourth embodiment of an integral field emission control device that is utilized to control at least a plurality of FEDs of a display unit in accordance with the present invention. At least a first substantially planar FED functions to integrally controlling at least a plurality of FEDs of a display unit, and is comprised of at least a plurality of emitter tips (208), for emitting electrons, at least a first gate extraction electrode (202), and at least a first anode electrode (203), for collecting at least some emitted electrons. Each of the at least plurality of emitter tips (208) is operably coupled to at least a first second device gate extraction electrode of the plurality of second device gate extraction electrodes (204) which second device gate extraction electrodes (204) are substantially peripherally, symmetrically disposed each about one of a plurality of apertures (205). An appropriate potential applied to selected emitter tips (208) of the substantially planar FED is operably applied also to at least the plurality of second device gate extraction electrodes (204). Emitted electron current obtained influences the potential at at least a selected second device gate extraction electrode of the plurality of second device gate extraction electrodes (204) due to the associated potential drop at an at least first impedance element (209) that is operably coupled to the at least first selected second device gate extraction electrode of at least the plurality of second device gate extraction electrodes (204). In this manner, the at least first integrated substantially planar FED effectively switches/modulates the potential that is applied to the plurality of second device gate extraction electrodes (204).

FIG. 3D sets forth a partial top plan view of a fifth embodiment of an integral field emission control device that is utilized to control at least a first FED of a display unit in accordance with the present invention. At least a plurality of substantially planar FEDs function to integrally control at least a plurality of FEDs of a display unit, and are comprised of at least a plurality of emitter tips (208), for emitting electrons, at least a first gate extraction electrode (202), and at least a plurality of substantially planar FED anode electrodes/second device gate extraction electrodes (304), for collecting at least some emitted electrons, that are each substantially peripherally, symmetrically disposed about one of a plurality of apertures (205). Substantially planar FED emitted electron current collected at at least a first of the plurality of substantially planar FED anode electrodes/second device gate extraction electrodes (304) influences the potential at at least a first selected one of the plurality of substantially planar FED anode electrodes/second device gate extraction electrodes (304) due to the associated potential drop at an at least first impedance element (209) that is operably coupled to at least a selected anode electrode/second device gate extraction electrode of the plurality of substantially planar FED anode electrodes/second device gate extraction electrodes (304). In this manner, the at least first integrated substantially planar FED effectively switches/modulates the potential that is applied to the plurality of second device gate extraction electrodes (304).

FIG. 4A illustrates a side-elevational cross-sectional view of a first embodiment of at least a first integral field emission control device that is utilized to control at least a first FED of a display unit in accordance with the present invention, the at least first integrally controlled field emission device substantially as described previously with reference to FIG. 2B, and further illustrating a display faceplate/viewing screen (402) that is typically substantially optically transparent and distally disposed with respect to the at least first second device electron emitter electrode (210). At least a first layer of cathodoluminescent material (403) is disposed on at least a part of a surface of the at least first faceplate/-viewing screen (402), substantially being in the intervening region between the at least first viewing screen (402) and at least first second device electron emitter electrode (210) such that emitted electrons traversing the intervening region substantially impinge on the at least first layer of cathodoluminescent material (403), providing a desired display. If desired, a layer of substantially optically transparent conductive material (not depicted) may be interposed between the at least first faceplate/viewing screen (402) and the at least first layer of cathodoluminescent material (403) to function as an anode electrode to collect at least some emitted electrons impinging on and traversing the thickness of the at least first layer of cathodoluminescent material (403), providing the desired display. Alternatively to/-coincidentally with the utilization of a layer of substantially optically transparent conductive material, a layer of substantially reflective conductive material (not depicted) may be disposed on a surface of the at least first layer of cathodoluminescent material (403) to function as an anode, to collect at least some electrons impinging on the at least a first layer of cathodoluminescent material (403). At least a first integral controlling substantially planar FED (401), as described previously with reference to FIG. 2B, comprising at least a first substantially planar FED electron emitter electrode (201), at least a first substantially planar FED gate extraction electrode (202), and at least a first substantially planar FED anode electrode (203) and at least a first second device gate extraction electrode (204), is employed to effectively switch/modulate a rate of electron emission from the at least first second device electron emitter electrode (210) for collection at the at least first layer of cathodoluminescent material (403). Cathodoluminescent materials emit photons as a result of energy imparted to the cathodoluminescent material by impinging electrons. Switching/modulating the rate of electron emission from the at least first second device electron emitter electrode (210) results in switching/modulating the photon emission rate from the at least first layer of cathodoluminescent material (403), thereby allowing integral field emission control device of the display unit.

FIG. 4B illustrates a side-elevational cross-sectional depiction of a sixth embodiment of an integrally controlled field emission device display unit in accordance with the present invention, wherein at least a plurality of second FEDs, described previously with reference to FIG. 4A, are controlled by a first integral controlling substantially planar FED (401), described previously with reference to FIG. 4A. The display typically functions substantially as described above.

FIG. 5A is a partial side-elevational cross-sectional view of a seventh embodiment of an integrally controlled field emission device display unit in accordance with the present invention, wherein a substrate is comprised of at least a first substantially optically transparent faceplate/viewing screen (501) and at least a first layer of cathodoluminescent material (502) substantially disposed on at least a part of a surface of the at least first faceplate/viewing screen (501). At least a first insulator layer (503) having at least a first aperture (507) disposed substantially through the thickness of the at least first layer of insulator material (503) is substantially disposed on at least a part of the at least first layer of cathodoluminescent material (502). At least a first non-insulator layer/gate extraction electrode (504) is substantially disposed on at least a part of the at least first insulator layer (503) and substantially peripherally symmetrically at least partially about the at least first aperture (507). An at least second layer of insulator material is substantially disposed on at least a part of the at least first non-insulator layer/gate extraction electrode (504) and, if desired, on at least a part of any exposed part of the at least first insulator layer (503). An at least second non-insulator layer is substantially disposed on at least a part of the at least second insulator layer (505) such that at least a plurality of electrically isolated regions of the at least second non-insulator layer each comprise at least a first substantially planar FED (401), substantially as described previously with reference to FIG. 2B, and being utilized to switch/modulate the rate of electron emission from the at least first second device electron emitter electrode (506), thereby switching/modulating the photon emission rate from the at least first layer of cathodoluminescent material (502) and selecting a desired display. The device of FIG. 5A functions as at least a first integrally controlled field emission device display unit wherein at least some electrons emitted from the at least first second device electron emitter (506) are accelerated into an at least first aperture (507) region, at least some of which subsequently impinging on the at least first layer of cathodoluminescent material (502).

Figure 5B:
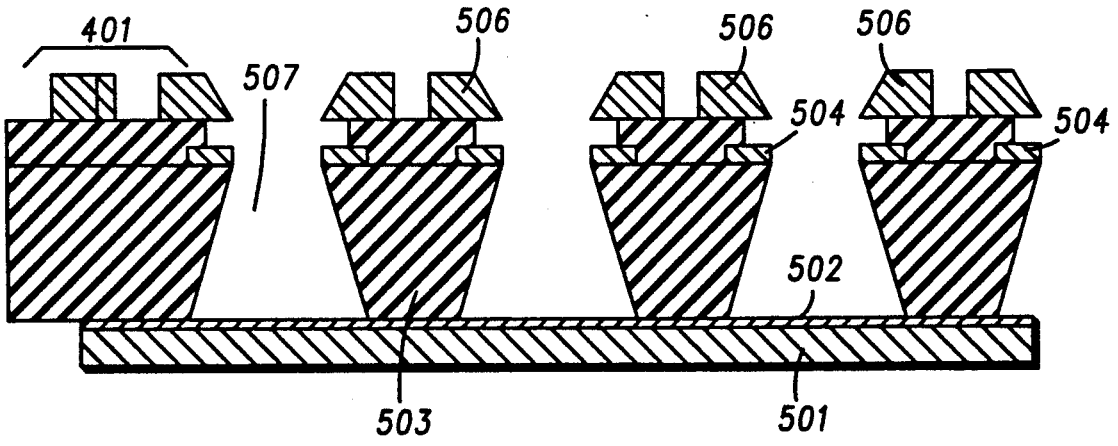
FIG. 5B is a side-elevational cross-sectional view of an eighth embodiment of an integrally controlled field emission device display in accordance with the present invention.

FIG. 5B shows a side-elevational cross-sectional depiction of a eigth embodiment of an integrally controlled field emission device display in accordance with the present invention, substantially as described previously with reference to FIG. 5A, and further, wherein at least a plurality of second FEDs are controlled by a first integral controlling substantially planar FED (401) described previously with reference to FIG. 4A.

The integrally controlled field emission device display of the present invention utilizes integral control devices comprised substantially of at least a first substantially planar FED that controls electron emission rate of at least a second set of FEDs by switching-/modulating a potential applied to the gate extraction electrode/electron emitter electrode of the at least second set of FEDs. Incorporating control integrally into an FED display unit by utilizing at least a first integral FED control allows for construction of FED display units with less fabrication complexity.

I claim:

1. An integrated field emission control device display unit comprising:

A) a substrate having at least a primary surface;

B) a first insulator layer substantially disposed on at least a part of the at least a primary surface of the substrate and having at least a first aperture;

C) a first electron emitter, for emitting electrons, substantially disposed in the at least first aperture of the at least first insulator layer, and further, substantially disposed on at least a part of the primary surface of the substrate;

D) a first non-insulator layer substantially disposed on at least a part of the at least first insulator layer, and substantially formed to comprise at least:

a first integrated field emission control device emitter electrode, for emitting electrons, wherein at least a part of the at least first integrated field emission control device emitter electrode is disposed substantially symmetrically and peripherally about at least a part of the at least first aperture;

a first integrated field emission control device anode electrode disposed distally with respect to the first integrated field emission control device emitter electrode for collecting at least some of the electrons emitted by the first integrated field emission control device emitter electrode; and a first integrated field emission control device gate electrode disposed in an intervening space between the first integrated field emission control device emitter electrode and the first integrated field emission control device anode electrode for controlling electron flow from the first integrated field emission control device emitter electrode to the first integrated field emission control device anode electrode;

E) an anode including a first display faceplate having at least a first layer of cathodoluminescent material disposed thereon, and being distally disposed with respect to the at least first electron emitter for collecting at least some of the electrons emitted by the first electron emitter;

such that the at least first integrated electron control device electrodes are disposed substantially in a planar fashion relative to one another and substantially control impingement of at least some of the emitted electrons from the first electron emitter on the at least first layer of cathodoluminescent material.

2. An integrated field emission control device display unit as claimed in claim 1, wherein the at least first integrated field emission control device emitter electrode for emitting electrons is comprised of a plurality of selectively formed geometric discontinuities substantially having a small radius of curvature.

3. A display unit, integrally controlled by a substantially planar field emission device comprising:

A) a substrate having a primary surface;

B) an insulator layer disposed on the primary surface of the substrate and having an aperture therethrough;

C) an electron emitter, for emitting electrons, disposed in the aperture of the insulator layer and on the primary surface of the substrate;

D) a non-insulator layer disposed on the insulator layer and defining a plurality of electrically isolated regions forming a substantially planar field emission control device including at least a control device emitter for emitting electrons and a control device anode distally disposed relative to the control device emitter for collecting at least some electrons emitted from the control device emitter, one of the control device emitter and control device anode being disposed substantially symmetrically and peripherally, at least partially about the aperture; and E) a display faceplate having a layer of cathodoluminescent material disposed thereon, and being distally disposed with respect to the electron emitter and the field emission control device, such that the substantially planar field emission control device, integrally formed in the display unit, provides impingement control of electrons emitted by the electron emitter on the layer of cathodoluminescent material.

4. A display unit, integrally controlled by a substantially planar field emission device as claimed in claim 3 wherein the field emission control device further includes a control device gate electrode disposed in an intervening space between the control device emitter and the control device anode electrode for controlling electron flow from the control device emitter to the control device anode.

5. A field emission device display unit comprising:

A) a substrate having a primary surface with a layer of cathodoluminescent material disposed thereon;

B) a first insulator layer disposed on the layer of cathodoluminescent material and having an aperture therethrough;

C) a first non-insulator layer disposed on the first insulator layer, and further disposed at least partially substantially symmetrically and peripherally about at least a part of the aperture;

D) a second insulator layer disposed on the first non-insulator layer; and

E) a second non-insulator layer disposed on the second insulator layer and defining a plurality of electrically isolated regions forming a field emission control device including at least a control device emitter for emitting electrons and a control device anode distally disposed relative to the control device emitter for collecting at least some electrons emitted from the control device emitter, one of the control device emitter and control device anode being disposed substantially symmetrically and peripherally, at least partially about the aperture to function as an electron emitter for emitting electrons such that the layer of cathodoluminescent material, acting as an anode to collect at least some of the electrons emitted from the electron emitter, is excited to luminesce for display purposes, the field emission control device controlling electron emission and impingement of emitted electrons on the layer of cathodoluminescent material.

6. A field emission device display unit as claimed in claim 5 wherein the field emission control device further includes a control device gate electrode disposed in an intervening space between the control device emitter and the control device anode for controlling electron flow from the control device emitter to the control device anode.

* * * * *